US010773883B2

(12) United States Patent
Zettell

(10) Patent No.: US 10,773,883 B2
(45) Date of Patent: Sep. 15, 2020

(54) WRAP SYSTEMS

(71) Applicant: The Dragon Group, LLC, Hayden, ID (US)

(72) Inventor: Adrian William Zettell, Newburg, ND (US)

(73) Assignee: The Dragon Group, LLC, Hayden, ID (US)

( * ) Notice: Subject to any disclaimer, the term of this patent is extended or adjusted under 35 U.S.C. 154(b) by 55 days.

(21) Appl. No.: 15/976,663

(22) Filed: May 10, 2018

(65) Prior Publication Data

US 2019/0344960 A1 Nov. 14, 2019

(51) Int. Cl.

| | |
|---|---|
| ***B65D 90/06*** | (2006.01) |
| ***E04H 7/02*** | (2006.01) |
| ***E04F 13/072*** | (2006.01) |
| ***B65D 88/08*** | (2006.01) |
| ***B65D 81/38*** | (2006.01) |
| ***B65D 90/08*** | (2006.01) |
| ***E04F 13/08*** | (2006.01) |
| ***E04F 13/21*** | (2006.01) |

(52) U.S. Cl.

CPC ..... *B65D 90/06* (2013.01); *B65D 81/38* (2013.01); *B65D 88/08* (2013.01); *B65D 90/08* (2013.01); *E04F 13/072* (2013.01); *E04F 13/0801* (2013.01); *E04F 13/21* (2013.01); *E04H 7/02* (2013.01)

(58) Field of Classification Search

CPC ..... B65D 90/06; B65D 90/08; B65D 81/38; E04B 2002/0202; E04H 7/02; E04H 9/14; E04H 9/00; E04H 9/16; E04F 13/07; E04F 13/072; E04F 13/08; E04F 13/0832; E04F 13/0864; E04F 13/0801; E04F 13/0803; E04F 13/00; E04F 13/0862; E04F 13/09; E04F 13/21; E04F 2201/00; E04C 2/38

USPC ..... 220/694.1

See application file for complete search history.

(56) References Cited

U.S. PATENT DOCUMENTS

| | | | | | |
|---|---|---|---|---|---|
| 280,470 | A * | 7/1883 | Hayes | F24H 1/182 | 220/694.1 |
| 832,290 | A * | 10/1906 | Brown | B65D 90/08 | 52/246 |
| 3,667,187 | A * | 6/1972 | Jerit | B65D 90/08 | 52/592.1 |
| 3,672,107 | A * | 6/1972 | Santry | E04F 13/0803 | 52/235 |
| 4,188,759 | A * | 2/1980 | Liet | A01F 25/2009 | 52/192 |
| 4,202,147 | A * | 5/1980 | Krogh | B65D 90/08 | 52/245 |

(Continued)

*Primary Examiner* — Jessica T Fonseca

(74) *Attorney, Agent, or Firm* — Lee & Hayes, P.C.

(57) ABSTRACT

This application describes tank wrap systems that cover containers. The tank wrap systems include tank wraps having a single sheet of a first polymer having an interior surface formed of the first polymer that faces a container, and an exterior surface formed of the first polymer that faces opposite the interior surface. A first coupling member formed of a second polymer is affixed to the exterior surface of the single sheet, and the first coupling member is couplable to a second coupling member of another tank wrap to couple the tank wrap and the other tank wrap and allow the tank wrap system to removably cover the exterior of the container.

16 Claims, 6 Drawing Sheets

(56) References Cited

U.S. PATENT DOCUMENTS

| | | | | | |
|---|---|---|---|---|---|
| 4,240,562 | A * | 12/1980 | Holschlag | B65D 90/08 | 220/565 |
| 4,629,358 | A * | 12/1986 | Springston | E01O 5/22 | 404/35 |
| 5,261,555 | A * | 11/1993 | Rogers | B65D 81/3886 | 138/149 |
| 9,556,615 | B1 * | 1/2017 | Zettell | E04C 2/205 | |
| 2004/0049999 | A1 * | 3/2004 | Krieger | E04C 2/328 | 52/245 |
| 2008/0190065 | A1 * | 8/2008 | Craig | E04H 9/14 | 52/586.1 |
| 2014/0319130 | A1 * | 10/2014 | Speciale | B65D 90/08 | 220/4.12 |

* cited by examiner

WRAP SYSTEMS

BACKGROUND

Protective coatings often cover containers that store a product in harsh environments, such as coastal environments. Some protective coatings are applied on the containers when the containers, such as tanks, are in the harsh environments. However, applying the protective coatings while in the harsh environments is often relatively difficult. For example, applying the protective coating is often relatively difficult in the case of painting or spraying the protective coating onto the surface of the container in relatively high levels of humidity, and/or in relatively high winds. Moreover, given the difficulty in applying the protective coating onto the container in harsh environments, the surface of the container may become contaminated during the application of the protective coating which can damage and compromise the protective coating, reducing an effectiveness of the protective coating. Because the compromised protective coating must be repaired, the cost of repairing the compromised protective coating is increased. Further, the covering of the tanks with the protective coating may be labor intensive, again driving up a cost of protecting tanks.

Thus, there remains a need to develop new tank coverings formed of materials which are much more durable than existing protective coverings, are much faster to install than existing tank coverings, and/or are more cost effective than existing tank coverings.

BRIEF SUMMARY

This Brief Summary is provided to introduce simplified concepts relating to tank wrap systems for covering a container and techniques for covering a container which are further described below in the Detailed Description. This Summary is not intended to identify essential features of the claimed subject matter, nor is it intended for use in determining the scope of the claimed subject matter.

This disclosure relates to tank wrap systems including a first single sheet of a first polymer having a coupling member formed of a second polymer affixed to an exterior surface of the first single sheet of the first polymer, and techniques for installing such assemblies. In some embodiments, such tank wrap systems quickly and easily removeably cover and protect containers and, in the event of battering weather and/or human activity, such tank wrap systems remain undamaged and uncompromised, and protect the container. While this disclosure relates to tank wrap systems that quickly and easily removeably cover and protect containers, the tank wrap systems may also quickly and easily removeably cover and protect piping. For example, the tank wrap systems may quickly and easily removeably cover and protect pipes and/or fittings and, in the event of battering weather and/or human activity, such tank wrap systems remain undamaged and uncompromised, and protect the pipes and/or fittings. In some embodiments the piping may be insulated and the tank wrap systems may quickly and easily removeably cover and protect the insulated piping.

In some examples the tank wrap system may include a first tank wrap coupleable to a second tank wrap. For example, the first tank wrap may include a first coupling member (e.g., first angle bracket) and the second tank wrap may include a second coupling member (e.g., second angle bracket). The first coupling member affixed to the first tank wrap couples to the second coupling member affixed to the second tank wrap to allow the tank wrap system to removeably cover the exterior of the container. The first tank wrap may comprise a first single unit of a first polymer (e.g., a polyurea, such as sprayable polyurea) and the second tank wrap may comprise a second single unit of the first polymer. In one example, the first and second coupling members are each formed of a second polymer (e.g., a polyurea, such as self-leveling polyurea or self-leveling polyurea elastomer). The first coupling member is affixed to the exterior surface of the first single unit of the first polymer, and the second coupling member is affixed to the exterior surface of the second single unit of the first polymer. The first and second tank wraps may be used to protect the container (e.g., a storage tank, processing tank, a panel tank, etc.) that stores liquid and/or gas.

In an embodiment the first coupling member is a first bracket member (e.g., first angle bracket) arranged a distance from a first edge of the first single unit of the first polymer, and the second coupling member is a second bracket member (e.g., second angle bracket) arranged on a second edge of the second single unit of the first polymer. Further, the second edge of the second single unit of the first polymer may overlap the first edge of the first single unit of the first polymer and the second bracket member may abut the first bracket member to removeably cover the exterior of the container.

In an embodiment, the tank wrap system may further include a third tank wrap. The third tank wrap may include a third single unit of the first polymer and an edge of the third single unit of the first polymer may overlap an edge of the first single unit of the first polymer or an edge of the second single unit of first polymer. The edge of the third single unit of the first polymer may abut a tab member formed of the second polymer. The tab member may be affixed to the exterior surface of the first single unit of the first polymer or the tab member may be affixed to the exterior surface of the second single unit of the first polymer. The edge of the third single unit of the first polymer may overlap the edge of the first single unit of the first polymer or overlap the edge of the second single unit of the first polymer and provide for displacing moisture. For example, the third tank wrap may be removeably coupled to the first tank wrap or the second tank wrap disposed underneath the third tank wrap (e.g., a first tank wrap or a second tank wrap arranged below the third tank wrap) and the edge of the third tank wrap may overlap a portion of the underneath first or second tank wraps to displace moisture from the third tank wrap to the underneath first or second tank wraps.

In an embodiment, the third tank wrap includes a tab member formed of the second polymer affixed to the exterior surface of the third single unit of the first polymer. The tab member affixed to the exterior surface of the third single unit of the first polymer may abut the tab member affixed to the exterior surface of the first single unit of the first polymer or abut the tab member affixed to the exterior surface of the second single unit of the first polymer. In this embodiment, where the third tank wrap includes a tab member, the tab member of the third tank wrap and the tab member of the first tank wrap or the tab member of the second tank wrap may cooperatively couple the third tank wrap and the underneath first tank wrap or the underneath second tank wrap to allow the tank wrap system to removeably cover the exterior of the container.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
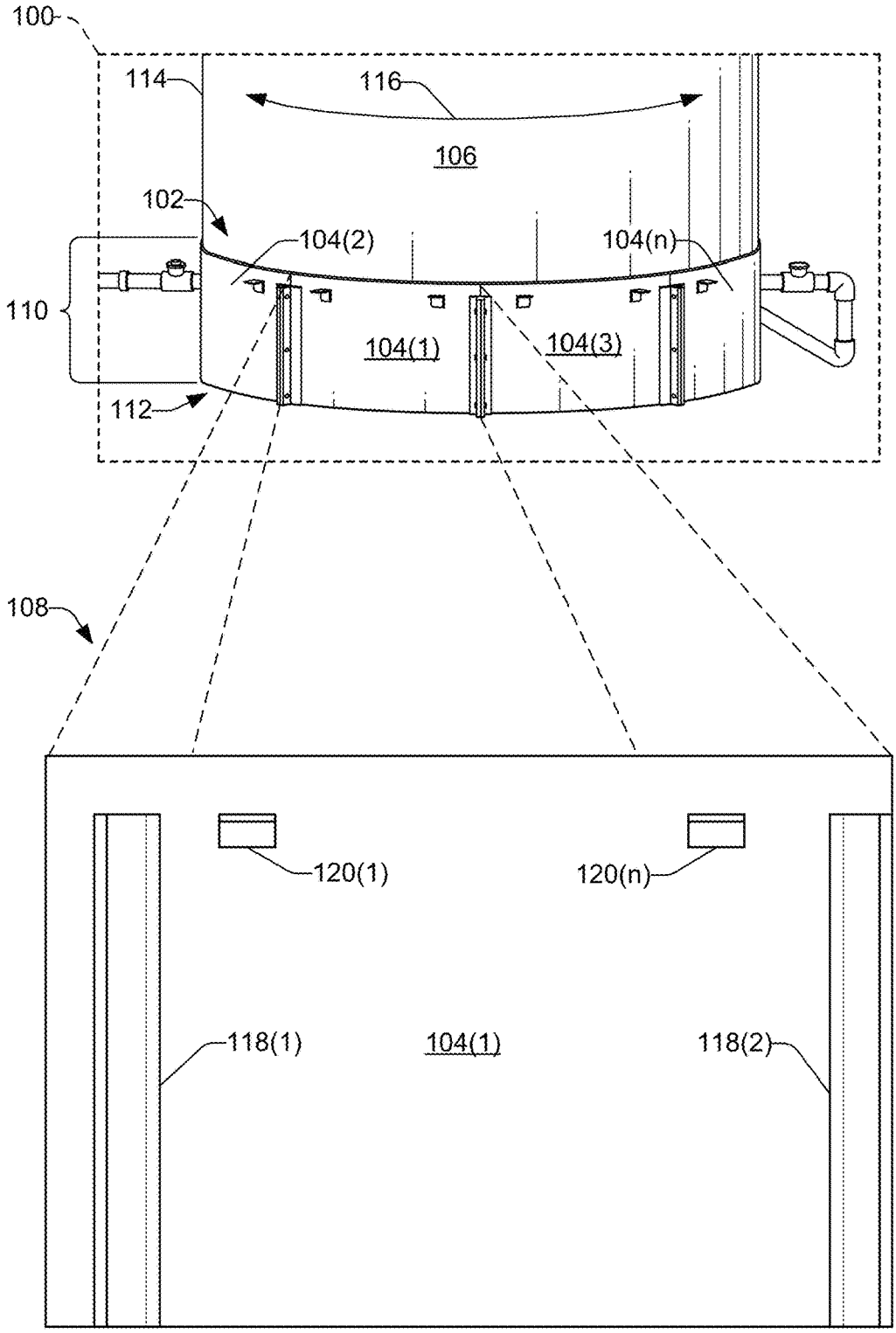
FIG. 1 illustrates a perspective view of a tank wrap system having a plurality of first tank wraps arranged on a container, and a front view of a first tank wrap of the plurality of first tank wraps arranged on the container.

As noted above, tank coverings are often labor intensive to apply, repair, and/or replace. Further, tank coverings are often painted and/or sprayed onto surfaces of tanks and because of relatively high humidity and/or relatively high winds the coverings are relatively difficult to apply onto the surfaces of the tanks. This application describes tank wrap systems, comprising a single unit of a first polymer (e.g., a polyurea, such as sprayable polyurea) having a coupling member formed of a second polymer (e.g., a polyurea, such as self-leveling polyurea or self-leveling polyurea elastomer) affixed to an exterior surface of the single unit of the first polymer, that reduce costs and require less labor to install as compared with other container coverings. These tank wrap systems are relatively more easily installed and more durable compared with other container coverings, and in an event of harsh environments (e.g., relatively high humidity and/or high winds), vermin, insects, and/or human activity remain undamaged and uncompromised and, hence, lessen the cost associated with repairing other container coverings that are damaged and compromised.

This application also describes various techniques for forming such tank wrap systems. By way of example and not limitation, the tank wrap systems herein may be used in the fields of oil and gas pipeline applications, food and beverage applications, watercraft applications, or any other applications where a container may need to be protected (e.g., because the environment surrounding the container is extremely high humidity and/or high winds).

In general, tank wrap systems as described in this application include a single unit of a first polymer (e.g., a polyurea, such as sprayable polyurea) having a coupling member formed of a second polymer (e.g., a polyurea, such as self-leveling polyurea or self-leveling polyurea elastomer) affixed to an exterior surface of the single unit of the first polymer and, therefore, are relatively more easily installed and more durable than painted and/or sprayed protective coatings applied while in the field or other existing claddings. Moreover, because the tank wraps each include coupling members that allow the tank wrap system to removeably cover the exterior of the container, the tank wrap systems can easily replace existing cladding that covers insulation such as fiberglass or mineral wool. This application also describes techniques for forming such tank wrap systems. However, other techniques for forming such tank wrap systems may also be used.

In some embodiments, the tank wrap systems may include tank wraps each having a single unit of polymer to prevent interaction between exterior surfaces of tanks and a surrounding environment. For example, the single unit of polymer prevents interaction between the exterior surfaces of tanks and battering weather. In one example, the single unit of polymer prevents moisture from interacting with the exterior surfaces of the tanks, thus substantially increasing a usable life of the tanks. In another example, the single unit of polymer prevents objects from interacting with the exterior surfaces of tanks, thus preventing the objects from damaging and/or compromising the surfaces of the tanks.

In another example, the single unit of polymer may replace cladding over existing insulation (e.g., fiberglass, mineral wool, foam, etc.) and prevent animals (e.g., mice, birds, and/or insects) from interacting with the insulation, thus preventing animals from penetrating the insulation. In another example, the single unit of polymer may prevent a liquid (e.g., oil) from a leaking and/or a broken container and/or pipe from interacting with the insulation, thus preventing the insulation from absorbing the liquid. In all of these examples, the single unit of polymer protects the integrity of the surfaces.

In another example, the single unit of polymer prevents a difference in electrochemical potential between the tank wrap systems covering the containers, thus preventing corrosion (e.g., chemical reaction occurring by an electrochemical mechanism) of the containers. For example, because the single unit of polymer has an electrical resistance (e.g., in ohms Ω), the single unit of polymer reduces, prevents or stops the flow of electrons, thus preventing corrosion of the containers. In this example, the single unit of polymer protects the integrity of the containers, pipes, and/or fittings associated with the containers.

In the example where the single unit of polymer prevents interaction between the insulation and battering weather, the single units of polymer are relatively more durable than existing cladding systems. For example, because the single unit of polymer prevents interaction between the insulation and battering weather, the single unit of polymer can resist being damaged and remain uncompromised, thus lessening the cost associated with repairing other container cladding that are damaged and compromised by battering weather.

In some examples coupling members (e.g., support members, fixture members, bracket members, tab members, etc.) may be affixed to exterior surfaces of single units of polymer (e.g., a first single unit of a first polymer, a second single unit of a first polymer, a third single unit of the first polymer, etc.) via coating the coupling members and the exterior surfaces of the single units of polymer with a sprayable polymer (e.g., a polyurea, such as sprayable polyurea). In one example, the sprayable polymer coating the coupling members and the exterior surfaces of the single units of polymer may have a wall thickness ranging from about 0.01 inches (0.2 millimeters) to about 0.04 inches (1 millimeters). In another example, the sprayable polymer coating the coupling members and the exterior surfaces of the single units of polymer may have a wall thickness of about 0.02 inches (0.5 millimeters).

A color of the sprayable polymer may vary depending on the specific application. For example, the color of the sprayable polymer may be dependent on a color of other neighboring containers and/or neighboring equipment. For example, the other neighboring containers and/or equipment may have a silver color and the color of the sprayable polymer may be the same silver color so that the tank wrap system blends in or matches the neighboring containers and/or equipment. In another example, the color of the sprayable polymer may be dependent on a reflectivity of other neighboring containers and/or neighboring equipment. For example, the other neighboring containers and/or equipment may comprise stainless steel, aluminum, copper, etc. that is reflective and the color of the sprayable polymer may have the same reflectivity so that the tank wrap system blends in or matches the neighboring containers and/or equipment. In another example, the color of the sprayable polymer may be dependent on whether the color of the sprayable polymer should absorb or reflect light. For example, the color of the sprayable polymer may be a dark color (e.g., black) so that the tank wrap system absorbs light, or the color of the sprayable polymer may be a light color (e.g., white) so that the tank wrap system reflects light.

In some embodiments, the tank wrap systems may comprise a first tank wrap including a first bracket member arranged a distance from a first edge of a first single unit of polymer, and a second tank wrap including a second bracket member arranged on a second edge of a second single unit of polymer. The first bracket member and/or the second bracket member may be formed of a plastic, a composite, a fiberglass, a ceramic, a metal etc. In one example, the first bracket member and the second bracket member may be formed of a polymer (e.g., a polyurea, such as self-leveling polyurea or self-leveling polyurea elastomer). The first bracket member may be affixed to an exterior surface of the first single unit of polymer, and the second bracket member may be affixed to the exterior surface of the second single unit of polymer.

In an example where the tank wrap systems include a first bracket member arranged a distance from a first edge of a first single unit of polymer, and a second bracket member arranged on a second edge of a second single unit of polymer, the second edge of the second single unit of polymer may overlap the first edge of the first single unit of polymer, and the first bracket member may abut the second bracket member to allow the tank wrap system to removeably cover the container. For example, the cooperating first bracket member and second bracket member may provide for coupling the first and second tank wraps to removeably cover the container around a perimeter of the container (i.e., in a lateral direction relative to the container). Because the cooperating first and second bracket members may couple the first and second tank wraps to allow the tank wrap system to removeably cover the container, the cooperating first and second bracket members may allow the tank wrap systems to be installed and/or removed from containers in less time than other container coverings. In another example, the cooperating first and second bracket members may allow the tank wrap systems to be installed and/or removed from containers in confined spaces. For example, the cooperating first and second bracket members may allow the tank wrap systems to be installed and/or removed, via vertical access, from containers that are arranged within a short distance from neighboring containers and/or other structures that prevent access to portions (e.g., sides) of the containers. In another example, the cooperating first and second bracket members may allow the tank wrap systems to be installed and/or removed with little or no power tools. For example, the cooperating first and second bracket members may allow the tank wrap system to be installed and/or removed without using electric power tools that could possibly ignite a flammable product stored in the insulated container.

In some embodiments, the tank wrap systems may comprise a first tank wrap including a first tab member and a second tank wrap including a second tab member. The first tab member and/or the second tab member may be formed of a plastic, a composite, a fiberglass, a ceramic, a metal etc. In one example, the first tab member and the second tab members may be formed of a polymer (e.g., a polyurea, such as self-leveling polyurea or self-leveling polyurea elastomer). The first tab member may be affixed to an exterior surface of a first single unit of polymer (e.g., a first single unit of polyurea, such as sprayable polyurea) a distance from an edge of the first single unit of polymer. The second tab member may be affixed to an exterior surface of a second single unit of polymer (e.g., a second single unit of polyurea, such as sprayable polyurea) on an edge of the second single unit of polymer.

In an example where the tank wrap systems include a first tab member affixed to an exterior surface of a first single unit of polymer a distance from an edge of the first single unit of polymer, and a second tab member affixed to an exterior surface of a second single unit of polymer on an edge of the second single unit of polymer, the edge of the second single unit of polymer may overlap the edge of the first single unit of polymer, and the first tab member may abut the second tab member to allow the tank wrap system to removeably cover the container. For example, the edge of the second tank wrap may overlap the edge of the first tank wrap and the first tab member and the second tab member may cooperatively couple the second tank wrap to the underneath first tank wrap to allow the tank wrap system to removeably cover the container. For example, the cooperating first tab member and second tab member may provide for coupling the second tank wrap and the underneath first tank wrap to removeably cover the container vertically along a height of the container (i.e., in a vertical direction relative to the container). Because the first tab member and the second tab member may couple the second tank wrap and the underneath first tank wrap to allow the tank wrap system to removeably cover the container, the cooperating first tab member and second tab member may allow the tank wrap systems to be installed and/or removed from containers in less time than other container coverings. In another example, the cooperating first tab member and second tab member may allow the tank wrap systems to be installed and/or removed from containers in confined spaces. For example, the cooperating first tab member and second tab member may allow the tank wrap systems to be installed and/or removed, via vertical access, from containers that are arranged within a short distance from neighboring containers and/or other structures that prevent access to portions (e.g., sides) of the containers. In another example, the cooperating first tab member and second tab member may allow the tank wrap systems to be installed and/or removed with little or no power tools. For example, the cooperating first tab member and second tab member may allow the tank wrap system to be installed and/or removed without using electric power tools that could possibly ignite a fuel stored in the insulated container.

In some embodiments, the first and second tank wraps may be substantially deformable (e.g., pliable, flexible, bendable, etc.) to provide for having a curvilinear shape having an arc to fit on an exterior of a cylindrical container. For example, the exterior of the container may comprise a curvilinear shape having an arc, and the single units of polymer may be substantially deformable to have a curvilinear shape having an arc equal to the arc of the exterior of the container to fit on the exterior of the cylindrical container. For example, the single units of polymer may be substantially deformable and wrap around the exterior of the cylindrical container to fit on the exterior of the cylindrical container. In one example, the first and second tank wraps may be deformable to have an arc equal to an arc of an exterior of a container having a diameter of about 12 feet (3.5 meters). In another example, the first and second tank wraps may be deformable to have an arc equal to an arc of an exterior of a container having a diameter of about 14 feet (4 meters). In another example, the first and second tank wraps may be deformable to have an arc equal to an arc of an exterior of a container having a diameter of about 55 feet (17 meters). In another example, the first and second tank wraps may be deformable to have an arc equal to an arc of an exterior of a container having a diameter of about 1 foot (0.3 meters). In another example, the first and second tank wraps may be deformable to have an arc equal to an arc of an exterior of a container having a diameter of about 1 foot (0.3 meters) to about 120 feet (37 meters).

Similarly, the thickness of the first and second tank wraps may vary depending on the specific application. In some examples, the first and second tank wraps may have a thickness ranging from about 0.06 inches (1.5 millimeters) to about 0.08 inches (2 millimeters); however, in other examples, the thickness of the first and second tank wraps may be less than 0.06 inches (1.5 millimeters) or greater than 0.08 inches (2 millimeters).

Also, in some embodiments, a polymer may coat the exterior surface of the single units of polymer and the coupling members (e.g., support members, fixture members, bracket members, angle bracket members, tab members, etc.). For example, the polymer coating the exterior surface of the single units of polymer and the coupling members may be a sprayable polymer (e.g., a polyurea, such as sprayable polyurea). The sprayable polymer coating the exterior surface of the single units of polymer and the coupling members may range from about 0.01 inches (0.2 millimeters) thick to about 0.04 inches (1 millimeter) thick. However, the sprayable polymer coating the exterior surface of the single units of polymer and the coupling members need not be the same. In one example, the sprayable polymer on the exterior surface may be thinner than the sprayable polymer on the coupling members. In another example, the coupling members and the immediate area on the outside surface surrounding the coupling members may be layered with the sprayable polymer, while the remaining portion of the outside surface may not be layered with the sprayable polymer. However, in other embodiments, any other thickness of sprayable polymer may be used. Furthermore, the thickness of the sprayable polymer layered on the exterior surface and/or the coupling members may be non-uniform.

These and other aspects of the tank wrap systems will be described in greater detail below with reference to several illustrative embodiments.

Examples of Tank Wrap Systems

This section describes example tank wrap systems comprising single units of polymers and coupling members coated in a sprayable polymer. These and numerous other tank wrap systems can be formed according to the techniques described in this section.

FIG. 1 illustrates a perspective view 100 of a tank wrap system 102 having a plurality of first tank wraps 104(1), 104(2), 104(3), through **104(*n*) arranged on a container 106, and a front view 108 of the first tank wrap 104(1) of the plurality of first tank wraps 104(1)-104(*n*) arranged on the container 106. The container 106 may comprise a storage tank, a processing tank, a panel tank, etc. for storing a fluid or a gas. As shown in FIG. 1, the tank wrap system 102 comprises a row 110 of the plurality of first tank wraps 104(1)-104(*n*) covering the container 106. While FIG. 1 shows a row 110 covering the container 106, one or more additional rows of tank wraps may be coupled together and cover the container 106. For example, a row of a plurality of second tank wraps (described below in detail with regard to FIG. 3) may be coupled to the row 110 of the plurality of first tank wraps 104(1)-104(*n*). For example, a plurality of second tank wraps may be arranged above, and coupled to, the row 110 of the plurality of first tank wraps 104(1)-104(*n*). Moreover, while FIG. 1 shows the row 110 of the plurality of first tank wraps 104(1)-104(*n*) arranged adjacent to a bottom 112 of the container 106, other tank wraps may be arranged adjacent to the bottom 112 of the container 106. For example, one or more of the plurality of second tank wraps (described below in detail with regard to FIG. 3) may be arranged adjacent to the bottom 112 of the container 106. Further, while FIG. 1 shows the container 106 having an exterior 114 that is substantially curvilinear shaped and having an arc 116, the container 106 may have any shape. For example, the container 106** may have a rectilinear shape, a triangular shape, rectangular shape, hexagonal shape, octagonal shape, etc.

Each of the plurality of first tank wraps **104(1)-104(*n*) may include a first coupling member 118(1) and a second coupling member 118(2). The first and second coupling members 118(1) and 118(2) of each of the plurality of first tank wraps 104(1)-104(*n*), respectively, may provide for coupling the plurality of first tank wraps 104(1)-104(*n*) to removeably cover the container around a perimeter of the container 106 (i.e., in a lateral direction relative to the container). For example, the first coupling member 118(1) of the first tank wrap 104(1) may provide for coupling a second coupling member of the second tank wrap 104(2), and the second coupling member 118(2) of the first tank wrap 104(1) may provide for coupling a first coupling member of the third tank wrap 104(3), in a lateral direction relative to the container 106 and to form the row 110 of the plurality of first tank wraps 104(1)-104(*n*) around the perimeter of the container 106. For example, the first coupling member 118(1) of the first tank wrap 104(1) may abut a second coupling member of the second tank wrap 104(2) and the second coupling member 118(2) of the first tank wrap 104(1) may abut a first coupling member of the third tank wrap 104(3) arranged in the row 110 of the plurality of first tank wraps 104(1)-104(*n*) (described in more detail below with regard to FIG. 2**).

FIG. 1 illustrates each of the plurality of first tank wraps **104(1)-104(*n*) may include one or more tab members 120(1) and 120(*n*), respectively. The one or more tab members 120(1) and 120(*n*) of the plurality of first tank wraps 104(1)-104(*n*) may provide for coupling a second plurality tank wraps (not shown) vertically along a height of the container 106 (i.e., in a vertical direction relative to the container 106) to form another row of tank wraps around the perimeter of the container 106. For example, one or more tab members of a plurality of second tank wraps arranged in another row above the plurality of first tank wraps 104(1)-104(*n*) may abut the one or more tab members 120(1) and 120(*n*) of the plurality of first tank wraps 104(1)-104(*n*) arranged in the row 110 (described in more detail below with regard to FIG. 3**).

Figure 2:
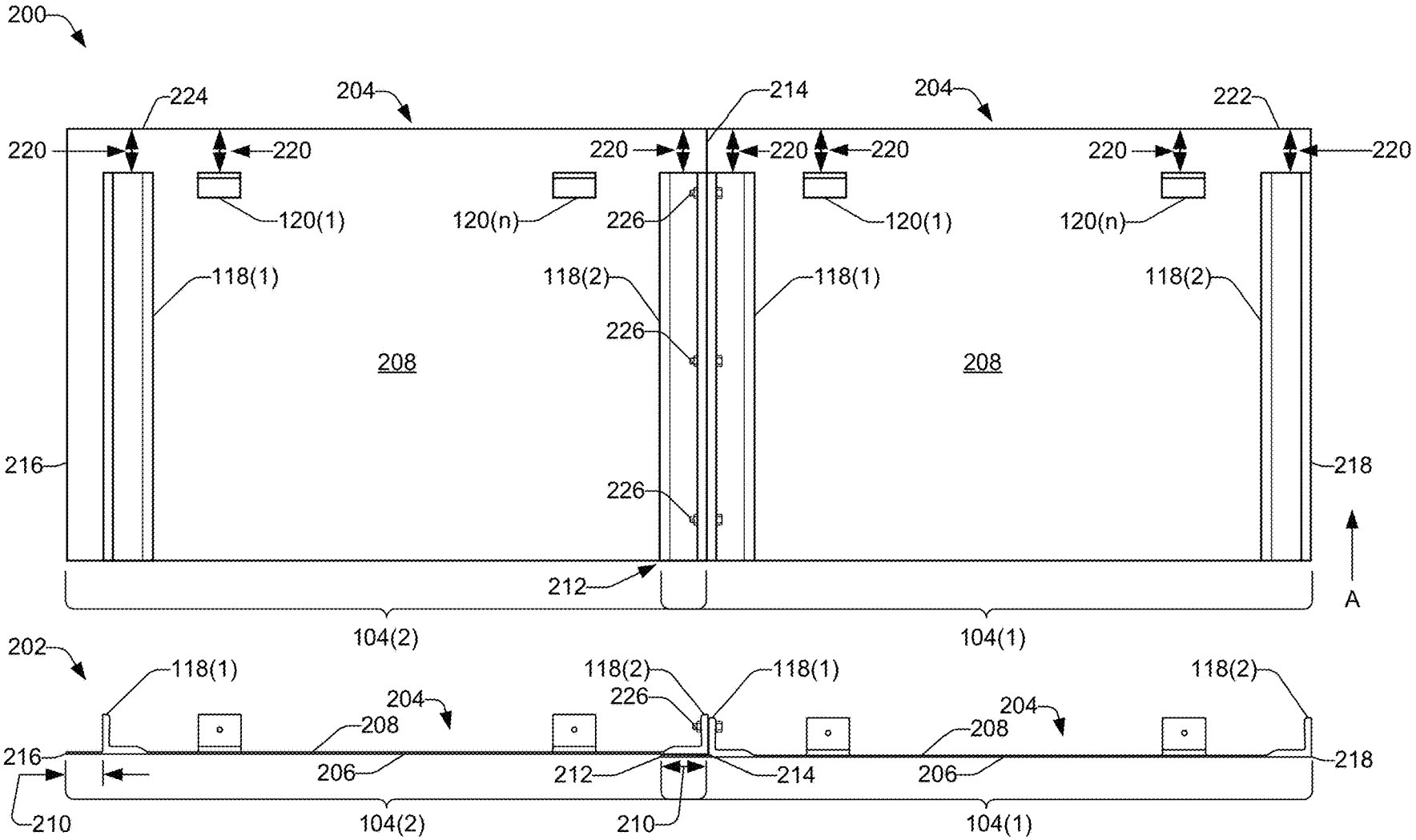
FIG. 2 illustrates a front view and a side view of two first tank wraps of the plurality of first tank wraps illustrated in FIG. 1 coupled together.

FIG. 2 illustrates a front view 200 and a bottom view 202 (looking up in the direction A) of the two first tank wraps 104(1) and 104(2) of the plurality of first tank wraps 104(1)-104(*n*) illustrated in FIG. 1 coupled together. FIG. 2 illustrates the first tank wrap 104(1) including a single unit of polymer 204 and the second tank wrap 104(2) including the single unit of polymer 204. The single unit of polymer 204 having an interior surface 206 formed of a first polymer, and an exterior surface 208 formed of the first polymer. The single unit of polymer 204 may be a sheet of sprayable polymer formed of a single layered sheet, where a thickness of the sheet may range, for example, between about 0.06 inches (1.5 millimeters) and about 0.08 inches (2 millimeters), and may be substantially uniform across the width and length of the sheet. However, the thickness may be less than or greater than the example range. The single unit of polymer 204 may be formed of sprayable polymer (e.g., a sprayable polyurea), and the interior surface 206 may be formed of the sprayable polymer, and the exterior surface 208 may be formed of the sprayable polymer.

FIG. 2 illustrates the first coupling members 118(1) and the second coupling members 118(2) affixed, respectively, to the exterior surfaces 208 of the single units of polymer 204. For example, the first and second coupling members 118(1) and 118(2) may be affixed to the exterior surfaces 208 of the single units of polymer 204 via coating the first and second coupling members 118(1) and 118(2) and the exterior surfaces 208 of the single units of polymer 204 with a layer of polymer (not shown in FIG. 2, see FIG. 6). For example, the first and second coupling members 118(1) and 118(2) may be adhered to the exterior surfaces 208 of the single units of polymer 204 by spraying a layer of sprayable polymer over the first and second coupling members 118(1) and 118(2) and the exterior surfaces 208 of the single units of polymer 204 (described in more detail below with regard to FIG. 5).

FIG. 2 illustrates the first coupling member 118(1) of the first tank wrap 104(1) and the second coupling member 118(2) of the second tank wrap 104(2) couple the first and second tank wraps 104(1) and 104(2) and allow the tank wrap system 102 to removably cover the exterior of the container 106. For example, the first coupling member 118(1) of the first tank wrap 104(1) may be arranged a distance 210 from an edge 212 of the single unit of polymer 204 of the first tank wrap 104(1), the second coupling member 118(2) of the second tank wrap 104(2) may be arranged on an edge 214 (i.e., flush with the edge 214) of the single unit of polymer 204 of the second tank wrap 104(2), and the edge 214 of the single unit of polymer 204 of the second tank wrap 104(2) may overlap the edge 212 of the single unit of polymer 204 of the first tank wrap 104(1), and the second coupling member 118(2) may abut the first coupling member 118(1) to removeably cover the exterior of the container 106. The first coupling member 118(1) of the second tank wrap 104(2) may be arranged the distance 210 from an edge 216 of the single unit of polymer 204 of the second tank wrap 104(2), the second coupling member 118(2) of the first tank wrap 104(1) may be arranged on an edge 218 (i.e., flush with the edge 218) of the single unit of polymer 204 of the first tank wrap 104(1). Moreover, the first coupling member 118(1) of the second tank wrap 104(2) may abut with a second coupling member (not shown) of a neighboring tank wrap (not shown), to allow the second coupling member 118(2) of the first tank wrap 104(1) to abut with a first coupling member (not shown) of another neighboring tank wrap (not shown) to removeably cover the exterior of the container 106. The distance 210 the first coupling member 118(1) of the first tank wrap 104(1) may be arranged from the edge 212 of the single unit of polymer 204 of the first tank wrap 104(1) may be about 3 inches (76 millimeters). Similarly, the distance 210 the first coupling member 118(1) of the second tank wrap 104(2) may be arranged from the edge 216 of the single unit of polymer 204 of the second tank wrap 104(2) may be about 3 inches (76 millimeters). When the second tank wrap 104(2) overlaps the first tank wrap 104(1) the first coupling member 118(1) of the first tank wrap 104(1) becomes flush with the second coupling member 118(2) of the second tank wrap 104(2), and the edge 214 of the second tank wrap 104(2) overlaps the edge 212 of the first tank wrap 104(1) the distance 210.

FIG. 2 illustrates the first and second coupling members 118(1) and 118(2) of the first tank wrap 104(1) may be arranged a distance 220 from an edge 222 of the single unit of polymer 204 of the first tank wrap 104(1) to allow the first tank wrap 104(1) to couple to another tank wrap (not shown) vertically along a height of the container 106 (i.e., in a vertical direction relative to the container 106). For example, the first and second coupling members 118(1) and 118(2) of the first tank wrap 104(1) may be arranged the distance 220 from the edge 222 of the single unit of polymer 204 of the first tank wrap 104(1) to provide for an edge of another tank wrap to overlap the edge 222 of the single unit of polymer 204 of the first tank wrap 104(1) the distance 220 to couple the other tank wrap to the first tank wrap 104(1) vertically along a height of the container 106 (i.e., in a vertical direction relative to the container 106). The distance 220 at which the first and second coupling members 118(1) and 118(2) of the first tank wrap 104(1) may be arranged from the edge 222 of the single unit of polymer 204 of the first tank wrap 104(1) may be about 3 inches (76 millimeters).

Similarly, FIG. 2 illustrates the first and second coupling members 118(1) and 118(2) of the second tank wrap 104(2) may be arranged the distance 220 from an edge 224 of the single unit of polymer 204 of the second tank wrap 104(2) to allow the second tank wrap 104(2) to couple to another tank wrap (not shown) vertically along a height of the container 106 (i.e., in a vertical direction relative to the container 106). For example, the first and second coupling members 118(1) and 118(2) of the second tank wrap 104(2) may be arranged the distance 220 from the edge 224 of the single unit of polymer 204 of the second tank wrap 104(2) to provide for an edge of another tank wrap to overlap the edge 224 of the single unit of polymer 204 of the second tank wrap 104(2) the distance 220 to couple the other tank wrap to the second tank wrap 104(2) vertically along a height of the container 106 (i.e., in a vertical direction relative to the container 106). The distance 220 the first and second coupling members 118(1) and 118(2) of the second tank wrap 104(2) may be arranged from the edge 224 of the single unit of polymer 204 of the second tank wrap 104(2) may be about 3 inches (76 millimeters).

FIG. 2 illustrates the one or more tab members 120(1) and 120(*n*) may be arranged the distance 220 from the edge 222 of the single unit of polymer 204 of the first tank wrap 104(1) to provide for an edge of another tank wrap to overlap the edge 222 of the single unit of polymer 204 of the first tank wrap 104(1) to couple the other tank wrap to the first tank wrap 104(1) vertically along a height of the container 106 (i.e., in a vertical direction relative to the container 106). The one or more tabs 120(1) and 120(*n*) may be L-shaped to accommodate coupling of the tank wraps vertically along a height of the container. The distance 220 the one or more tab members 120(1) and 120(*n*) of the first tank wrap 104(1) may be arranged from the edge 222 of the single unit of polymer 204 of the first tank wrap 104(1) may be about 3 inches (76 millimeters). Similarly, FIG. 2 illustrates the one or more tab members 120(1) and 120(*n*) may be arranged the distance 220 from the edge 224 of the single unit of polymer 204 of the second tank wrap 104(2) to provide for an edge of another tank wrap to overlap the edge 224 of the single unit of polymer 204 of the second tank wrap 104(2) to couple the other tank wrap to the second tank wrap 104(2) vertically along a height of the container 106 (i.e., in a vertical direction relative to the container 106). The distance 220 the one or more tab members 120(1) and 120(*n*) of the second tank wrap 104(2) may be arranged from the edge 224 of the single unit of polymer 204 of the second tank wrap 104(2) may be about 3 inches (76 millimeters). Each of the one or more tab members 120(1) and 120(*n*) may have a width of about 2 inches (50 millimeters), a length of about 2 inches (50 millimeters), and a height of about 2 inches (50 millimeters). Each of the tab members 120(1) and 120(*n*) may have a thickness of about 0.3 inches (8 millimeters). The tab member 120(1) may be separated a distance of about 24 inches (607 millimeters) from the tab member 120(*n*). The separation distance of the tab members 120(1) and 120(*n*) may be dependent on a size of a tank wrap to which the tab members 120(1) and 120(*n*) may be affixed. Each of the tab members 120(1) and 120(*n*) may have an L-shape to provide for coupling the tank wraps vertically along a height of the container 106 (i.e., in a vertical direction relative to the container 106). Because the tab members 120(1) and 120(*n*) have a relatively narrow width of about 2 inches (50 millimeters), the tab members 120(1) and 120(*n*) may provide for each of the first tank wraps 104(1)-104(*n*) and each of the second tank wraps 302(1)-302(*n*) to be deformable to have an arc equal to an arc of an exterior of the container 106 to wrap around the exterior of the container 106.

While FIG. 2 illustrates the first coupling member 118(1) being a bracket member (e.g., an angle bracket member) that extends across a substantial portion of the height of a tank wrap and formed of a single unit of polymer (e.g., a polyurea, such as self-leveling polyurea or self-leveling polyurea elastomer), the first coupling member 118(1) may be a plurality of shorter individual bracket members spread across the height of the tank wrap, where each shorter bracket member is formed of a single unit of polymer (e.g., a polyurea, such as self-leveling polyurea or self-leveling polyurea elastomer). Similarly, while FIG. 2 illustrates the second coupling member 118(2) being a bracket member (e.g., an angle bracket member) formed of a single unit of polymer (e.g., a polyurea, such as self-leveling polyurea or self-leveling polyurea elastomer), the second coupling member 118(2) may be a plurality of individual bracket members, each bracket member formed of a single unit of polymer (e.g., a polyurea, such as self-leveling polyurea or self-leveling polyurea elastomer). Each of the first and second coupling members 118(1) and 118(2) may have a width of about 2 inches (50 millimeters) and a height of about 2 inches (50 millimeters). Each of the first and second coupling members 118(1) and 118(2) may have an L-shape to provide for coupling the tank wraps around a perimeter of the container 106 (i.e., in a lateral direction relative to the container 106). The length of each of the first and second coupling members 118(1) and 118(2) may range from about 24 inches to about 96 inches. For example, the length of each of the first and second coupling members 118(1) and 118(2) may vary depending on a size of a tank wrap the first and second coupling members 118(1) and 118(2) may be affixed to. The first and second coupling members 118(1) and 118(2) may have a thickness of about 0.3 inches (8 millimeters). Because the first and second coupling members 118(1) and 118(2) have a relatively narrow width of about 2 inches (50 millimeters), the first and second coupling members 118(1) and 118(2) may provide for each of the first tank wraps 104(1)-104(*n*) and each of the second tank wraps 302(1)-302(*n*) to be deformable to have an arc equal to an arc of an exterior of the container 106 to wrap around the exterior of the container 106.

One or more fasteners 226 (e.g., nuts, bolts, tee nuts, prong tee nuts, propel nuts, etc.), a snap-fit clip, a press-fit clip, etc. may be arranged with the first and/or second coupling members 118(1) and 118(2) that tighten the first tank wrap 104(1) to the second tank wrap 104(2) on the exterior of the container 106.

Figure 3:
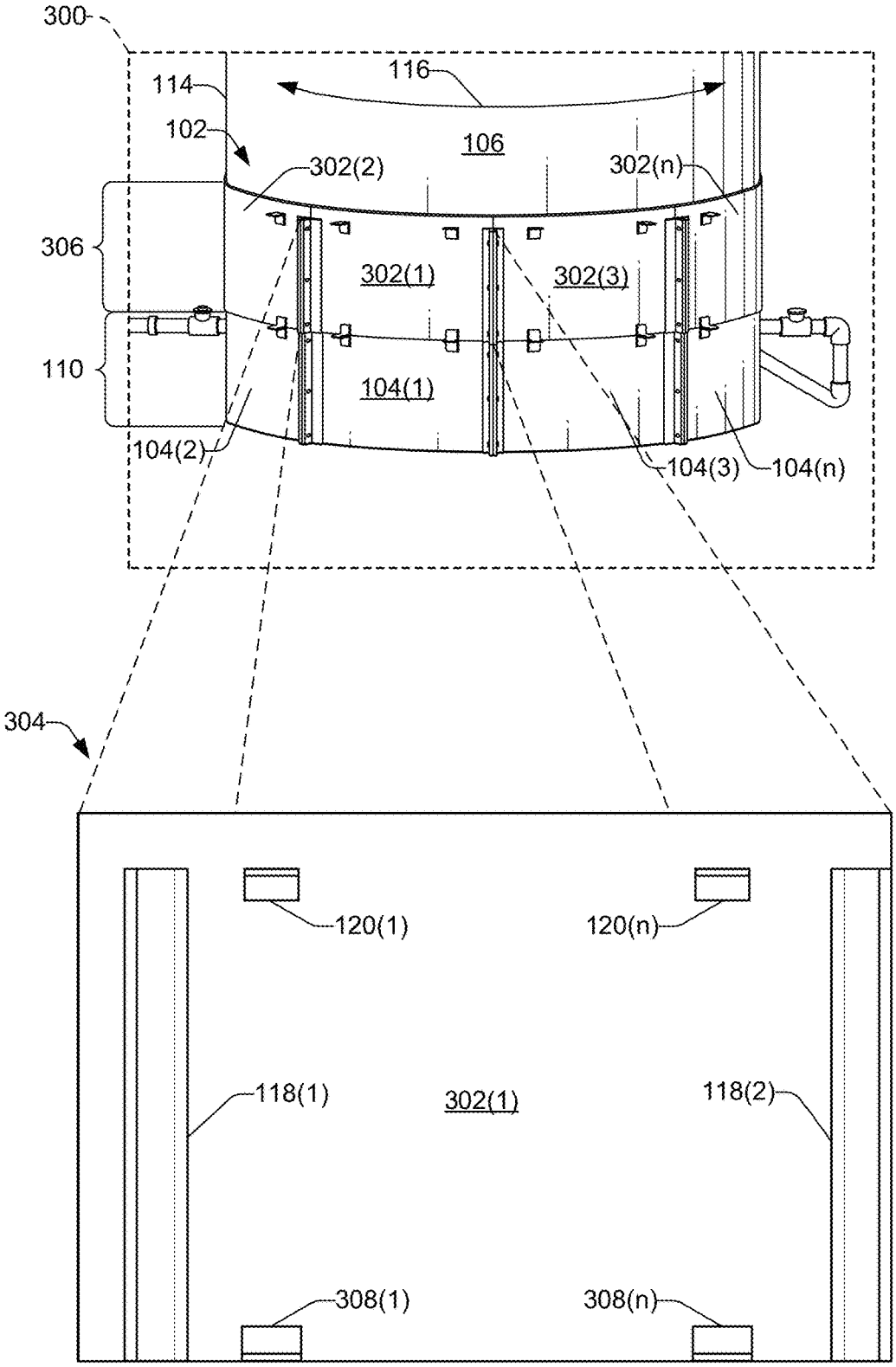
FIG. 3 illustrates a perspective view of the tank wrap system illustrated in FIG. 1 having a plurality of second tank wraps arranged on the container, and a front view of a second tank wrap of the plurality of second tank wraps arranged on the container.

FIG. 3 illustrates a perspective view 300 of the tank wrap system 102 illustrated in FIG. 1 having a plurality of second tank wraps 302(1), 302(2), 302(3), through 302(*n*) arranged on the container 106, and a front view 304 of the first tank wrap 302(1) of the plurality of second tank wraps 302(1)-302(*n*) arranged on the container 106. As shown in FIG. 3, the tank wrap system 102 comprises a row 306 of the plurality of second tank wraps 302(1)-302(*n*) covering the container 106. For example, FIG. 3 illustrates the plurality of second tank wraps 302(1)-302(*n*) arranged above, and coupled to, the row 110 of the plurality of first tank wraps 104(1)-104(*n*) arranged beneath the plurality of second tank wraps 302(1)-302(*n*).

Similar to the plurality of first tank wraps 104(1)-104(*n*) discussed above, FIG. 3 illustrates each of the plurality of second tank wraps 302(1)-302(*n*) may include the first coupling member 118(1) and the second coupling member 118(2) to provide for coupling the plurality of second tank wraps 302(1)-302(*n*) to removeably cover the container 106 around the perimeter of the container 106 (i.e., in a lateral direction relative to the container). For example, the first coupling member 118(1) of the first tank wrap 302(1) of the plurality of second tank wraps 302(1)-302(*n*) may provide for coupling a second coupling member of the second tank wrap 302(2) of the plurality of second tank wraps 302(1)-302(*n*), and the second coupling member 118(2) of the first tank wrap 302(1) of the plurality of second tank wraps 302(1)-302(*n*) may provide for coupling a first coupling member of the third tank wrap 302(3) of the plurality of second tank wraps 302(1)-302(*n*), in a lateral direction relative to the container 106 and to form the row 306 of the plurality of second tank wraps 302(1)-302(*n*) around the perimeter of the container 106. For example, the first coupling member 118(1) of the first tank wrap 302(1) of the plurality of second tank wraps 302(1)-302(*n*) may abut a second coupling member of the second tank wrap 302(2) and the second coupling member 118(2) of the first tank wrap 302(1) of the plurality of second tank wraps 302(1)-302(*n*) may abut a first coupling member of the third tank wrap 302(3) of the plurality of second tank wraps 302(1)-302(*n*) arranged in the row 306 of the plurality of plurality of second tank wraps 302(1)-302(*n*).

Further, similar to the plurality of first tank wraps 104(1)-104(*n*) discussed above, FIG. 3 illustrates each of the plurality of second tank wraps 302(1)-302(*n*) may include one or more tab members 120(1) and 120(*n*). The one or more tab members 120(1) and 120(*n*) of the plurality of second tank wraps 302(1)-302(*n*) may provide for coupling a second plurality tank wraps (not shown) vertically along a height of the container 106 (i.e., in a vertical direction relative to the container) to form another row of tank wraps around the perimeter of the container 106.

FIG. 3 illustrates each of the plurality of second tank wraps 302(1)-302(*n*) may include one or more tab members 308(1) and 308(n). The one or more tab members 308(1) and 308(n) of the plurality of second tank wraps 302(1)-302(n) may provide for coupling the plurality of second tank wraps 302(1)-302(n) vertically along a height of the container 106 (i.e., in a vertical direction relative to the container) to form another row tank wraps around the perimeter of the container 106. For example, the one or more tab members 308(1) and 308(n) of the plurality of second tank wraps 302(1)-302(n) arranged in the row 306 above the plurality of first tank wraps 104(1)-104(n) may abut the one or more tab members 120(1) and 120(n) of the plurality of first tank wraps 104(1)-104(n) arranged in the row 110 to couple the plurality of second tank wraps 302(1)-302(n) vertically along a height of the container 106 (i.e., in a vertical direction relative to the container).

Figure 4:
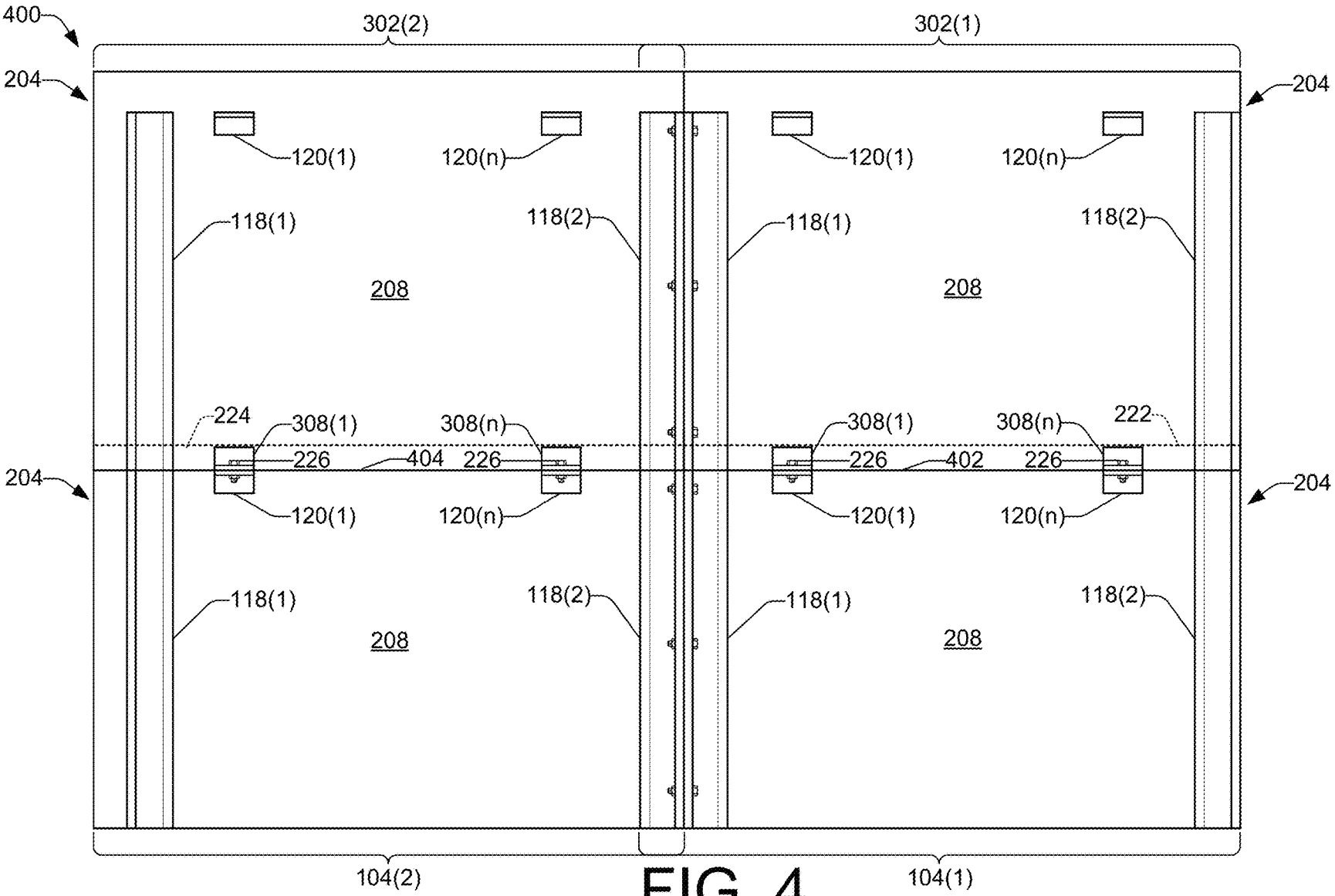
FIG. 4 illustrates a front view of two second tank wraps of the plurality of second tank wraps coupled together and coupled to the two first tank wraps of the plurality of first tank wraps coupled together illustrated in FIG. 3.

FIG. 4 illustrates a front view 400 of the first and second tank wraps 302(1) and 302(2) of the plurality of second tank wraps 302(1)-302(n) coupled together and coupled to the first and second tank wraps 104(1) and 104(2) of the plurality of first tank wraps 104(1)-104(n) coupled together illustrated in FIG. 3. For example, FIG. 4 illustrates the first coupling members 118(1) abutting the second coupling members 118(2), and the one or more tab members 308(1) and 308(n) abutting the one or more tab members 120(1) and 120(n).

FIG. 4 illustrates the one or more tab members 308(1) and 308(n) of the first tank wrap 302(1) of the plurality of second tank wraps 302(1)-302(n) affixed to the exterior surface 208 of the single unit of polymer 204 of the first tank wrap 302(1) of the plurality of second tank wraps 302(1)-302(n) and on an edge 402 (i.e., flush with the edge 402) of the single unit of polymer 204 of the first tank wrap 302(1) of the plurality of second tank wraps 302(1)-302(n). FIG. 4 illustrates the edge 402 of the single unit of polymer 204 of the first tank wrap 302(1) of the plurality of second tank wraps 302(1)-302(n) overlaps the edge 222 (shown as a hidden dashed line) of the single unit of polymer 204 of the first tank wrap 104(1) of the plurality of first tank wraps 104(1)-104(n). The edge 402 of the single unit of polymer 204 of the first tank wrap 302(1) of the plurality of second tank wraps 302(1)-302(n) may overlap the edge 222 of the single unit of polymer 204 of the first tank wrap 104(1) of the plurality of first tank wraps 104(1)-104(n) the distance 220. The edge 402 of the single unit of polymer 204 of the first tank wrap 302(1) of the plurality of second tank wraps 302(1)-302(n) may overlap the edge 222 of the single unit of polymer 204 of the first tank wrap 104(1) of the plurality of first tank wraps 104(1)-104(n) to provide for displacing moisture from the first tank wrap 302(1) of the plurality of second tank wraps 302(1)-302(n) to the underneath first tank wrap 104(1) of the plurality of first tank wraps 104(1)-104(n).

Similarly, FIG. 4 illustrates the one or more tab members 308(1) and 308(n) of the second tank wrap 302(2) of the plurality of second tank wraps 302(1)-302(n) affixed to the exterior surface 208 of the single unit of polymer 204 of the second tank wrap 302(2) of the plurality of second tank wraps 302(1)-302(n) and on an edge 404 (i.e., flush with the edge 404) of the single unit of polymer 204 of the second tank wrap 302(2) of the plurality of second tank wraps 302(1)-302(n). FIG. 4 illustrates the edge 404 of the single unit of polymer 204 of the second tank wrap 302(2) of the plurality of second tank wraps 302(1)-302(n) overlaps the edge 224 (shown as a hidden dashed line) of the single unit of polymer 204 of the second tank wrap 104(2) of the plurality of first tank wraps 104(1)-104(n). The edge 404 of the single unit of polymer 204 of the second tank wrap 302(2) of the plurality of second tank wraps 302(1)-302(n) may overlap the edge 224 of the single unit of polymer 204 of the second tank wrap 104(2) of the plurality of first tank wraps 104(1)-104(n) the distance 220. The edge 404 of the single unit of polymer 204 of the second tank wrap 302(2) of the plurality of second tank wraps 302(1)-302(n) may overlap the edge 224 of the single unit of polymer 204 of the second tank wrap 104(2) of the plurality of first tank wraps 104(1)-104(n) to provide for displacing moisture from the second tank wrap 302(2) of the plurality of second tank wraps 302(1)-302(n) to the underneath second tank wrap 104(2) of the plurality of first tank wraps 104(1)-104(n).

The one or more fasteners 226 may be arranged with the one or more tab members 120(1) and 120(n) and/or the one or more tab members 308(1) and 308(n). The one or more fasteners 226 may provide for tightening the first and second tank wraps 104(1) and 104(2) of the plurality of first tank wraps 104(1)-104(n) to the first and second tank wraps 302(1) and 302(2) of the plurality of second tank wraps 302(1)-302(n) on the exterior of the container 106.

Example Methods of Forming Tank Wrap Systems

Figure 5:
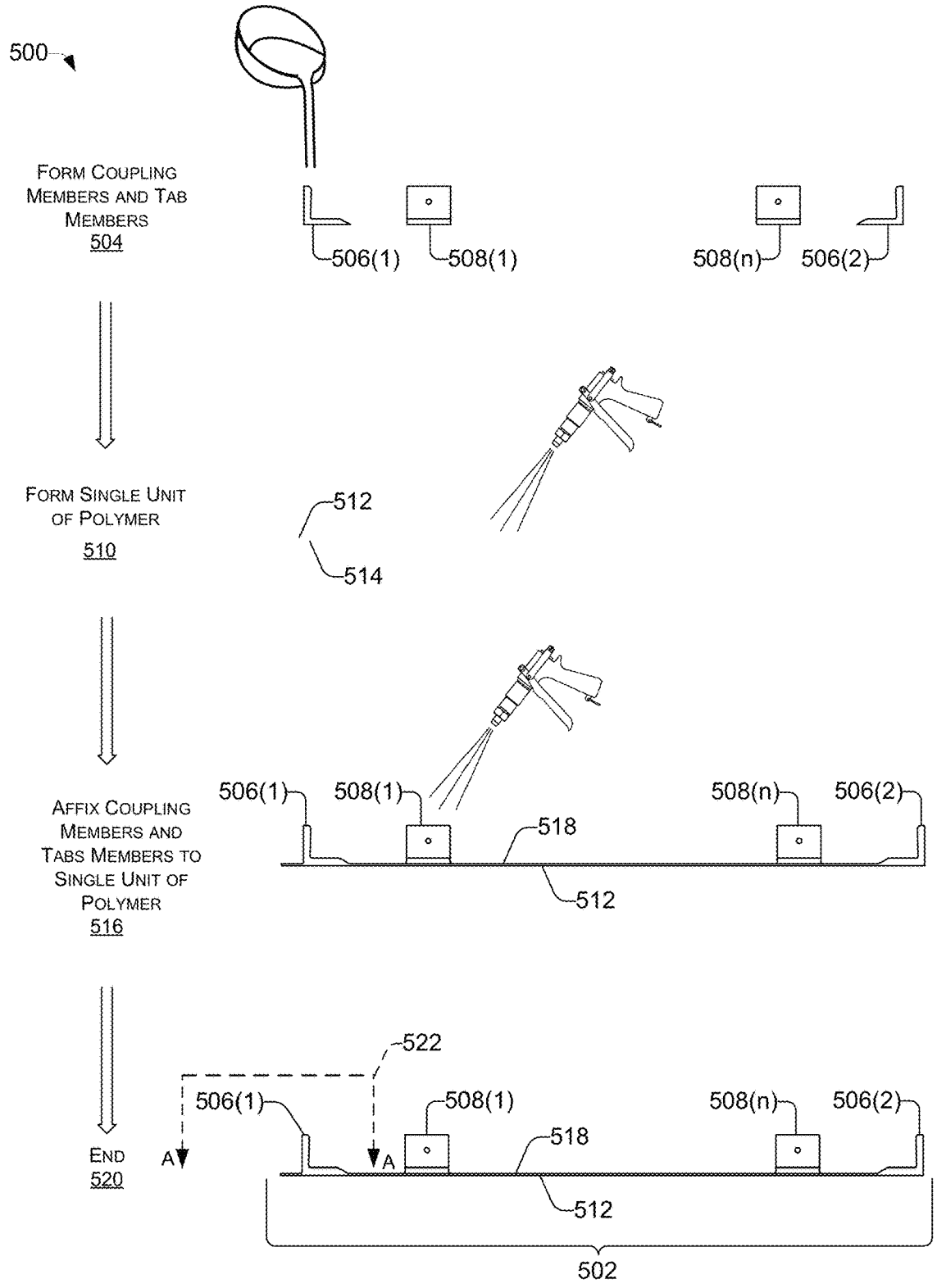
FIG. 5 illustrates an example process of forming a tank wrap of the tank wrap system for covering a container.

FIG. 5 illustrates an example process 500 of forming a tank wrap 502 (i.e., any one of the plurality of first tank wraps 104(1)-104(n) or the plurality of second tank wraps 302(1)-302(n)) of the tank wrap system 102 for covering the container 600. By way of example and not limitation, this process may be performed at a manufacturing facility, a plant, a foundry, a factory, an oil facility, a gas facility, a boat yard, in the field, or the like.

Process 500 includes operation 504, which represents forming first and second coupling members 506(1) and 506(2) and forming one or more tab members 508(1) and 508(n). The first and second coupling members 506(1) and 506(2) may be the same as the first and second coupling members 118(1) and 118(2). The one or more tab members 508(1) and 508(n) may be the same as the one or more tab members 120(1) and 120(n) and/or the one or more tab members 308(1) and 308(n). Forming the first and second coupling members 506(1) and 506(2) and the one or more tab members 508(1) and 508(n) may include pouring a polymer (e.g., a polyurea, such as self-leveling polyurea or self-leveling polyurea elastomer) into one or more molds, matrices, casts, etc. For example, a liquid form of the polymer may be received by a mold of a coupling member and/or a mold of a tab member. Forming the first and second coupling members 506(1) and 506(2) and the one or more tab members 508(1) and 508(n) may include curing the polymer. For example, the liquid polymer may be toughened or hardened in the one or more molds. Forming the first and second coupling members 506(1) and 506(2) and the one or more tab members 508(1) and 508(n) may also include cutting the cured polymer. For example, the toughened or hardened polymer may be cut to a preferred specification (e.g., dimensions). For example, the toughened or hardened polymer may be cut to a specification (e.g., dimensions) of a coupling member (e.g., a size of the first and second coupling members 118(1) and 118(2)), and/or the toughened or hardened polymer may be cut to a specification (e.g., dimensions) of a tab member (e.g., a size of the tab members 120(1), 120(n), 308(1) and 308(n)).

Process 500 continues with operation 510, which represents forming a single unit of polymer 512. The single unit of polymer 512 may be the same as the single unit of polymer 204. Forming the single unit of polymer 512 may include spraying a layer of sprayable polymer (e.g., a polyurea, such as sprayable polyurea) over a planar sheet of silicone 514. In one example, the single unit of polymer 512 may be sprayed onto the planar sheet of silicone 514 to a desired wall thickness. In one example, a wall thickness of the single unit of polymer 512 may vary depending on the specific application. For example, the wall thickness of the single unit of polymer 512 may be dependent on an environment of a container to be covered by the tank wrap systems. For example, the layer of sprayable polymer sprayed on the planar sheet of silicone 514 may have a wall thickness ranging from about 0.06 inches (1.5 millimeters) to about 0.08 inches (2 millimeters) to protect a container from a harsh environment. Forming the single unit of polymer 512 may include curing the layer of sprayable polymer on the planar sheet of silicone 514. For example, the layer of sprayable polymer may be toughened or hardened on the planar sheet of silicone 514. Forming the single unit of polymer 512 may also include removing the cured layer of sprayable polymer from the planar sheet of silicone 514. For example, the cured layer of sprayable polymer may be peeled from the planar sheet of silicone 514. The cured layer of sprayable polymer may be substantially deformable to provide for wrapping around an exterior of a cylindrical container to fit on the exterior of the cylindrical container. For example, the wall thickness of the cured layer of sprayable polymer may provide for deforming the cured layer of sprayable polymer to wrap the single unit of polymer 512 around an exterior of a cylindrical container to fit on the exterior of the cylindrical container. Forming the single unit of polymer 512 may also include cutting the cured layer of sprayable polymer to a preferred specification (e.g., dimensions). For example, the toughened or hardened layer of sprayable polymer may be cut to a specification (e.g., dimensions) of the single unit of polymer 512. In some examples, forming the single unit of polymer 512 may include texturing the single unit of polymer 512.

Process 500 continues with operation 516, which represents affixing the first and second coupling members 506(1) and 506(2) and the one or more tab members 508(1) and 508(*n*) to the single unit of polymer 512. For example, the first and second coupling members 506(1) and 506(2) and the one or more tab members 508(1) and 508(*n*) may be adhered to an exterior surface 518 of the single unit of polymer 512 via a double-sided bonding tape to prevent the first and second coupling members 506(1) and 506(2) and the one or more tab members 508(1) and 508(*n*) from being displaced while being sprayed with a layer of sprayable polymer (e.g., a polyurea, such as sprayable polyurea). Subsequent to being adhered to the exterior surface 518 of the single unit of polymer 512 via the double-sided bonding tape, the first and second coupling members 506(1) and 506(2) and the one or more tab members 508(1) and 508(*n*) are sprayed with a layer of sprayable polymer (e.g., a polyurea, such as sprayable polyurea). For example, the first and second coupling members 506(1) and 506(2) and the one or more tab members 508(1) and 508(*n*) may be adhered to the exterior surface 518 of the single unit of polymer 512 at a desired location and then the first and second coupling members 506(1) and 506(2), the one or more tab members 508(1) and 508(*n*), and the exterior surface 518 of the single unit of polymer 512 are subsequently covered with a layer of sprayable polymer (not shown in FIG. 5, see FIG. 6). The layer of sprayable polymer may be chemically bonded to the first and second coupling members 506(1) and 506(2), the one or more tab members 508(1) and 508(*n*), and the exterior surface 518 of the single unit of polymer 512.

In one example, a wall thickness of the coating of the sprayable polymer covering the first and second coupling members 506(1) and 506(2), the one or more tab members 508(1) and 508(*n*), and/or the exterior surface 518 of the single unit of polymer 512 may range from about 0.01 inches (0.2 millimeters) to about 0.04 inches (1 millimeter). In another example, a wall thickness of the coating of the sprayable polymer may be about 0.02 inches (0.5 millimeters). In some examples, affixing the first and second coupling members 506(1) and 506(2) and the one or more tab members 508(1) and 508(*n*) to the single unit of polymer 512 may include texturing the coating of sprayable polymer.

Process 500 may be completed with operation 520, which represents curing the coating of the sprayable polymer to complete the tank wrap 502. For example, the coating of the sprayable polymer may be cured on the first and second coupling members 506(1) and 506(2), the one or more tab members 508(1) and 508(*n*), and/or the exterior surface 518 of the single unit of polymer 512. For example, the coating of sprayable polymer may be toughened or hardened on the first and second coupling members 506(1) and 506(2), the one or more tab members 508(1) and 508(*n*), and/or the exterior surface 518 of the single unit of polymer 512. The cured coating of the sprayable polymer adhering the first and second coupling members 506(1) and 506(2) and the one or more tab members 508(1) and 508(*n*) on the exterior surface 518 of the single unit of polymer 512.

Figure 6:
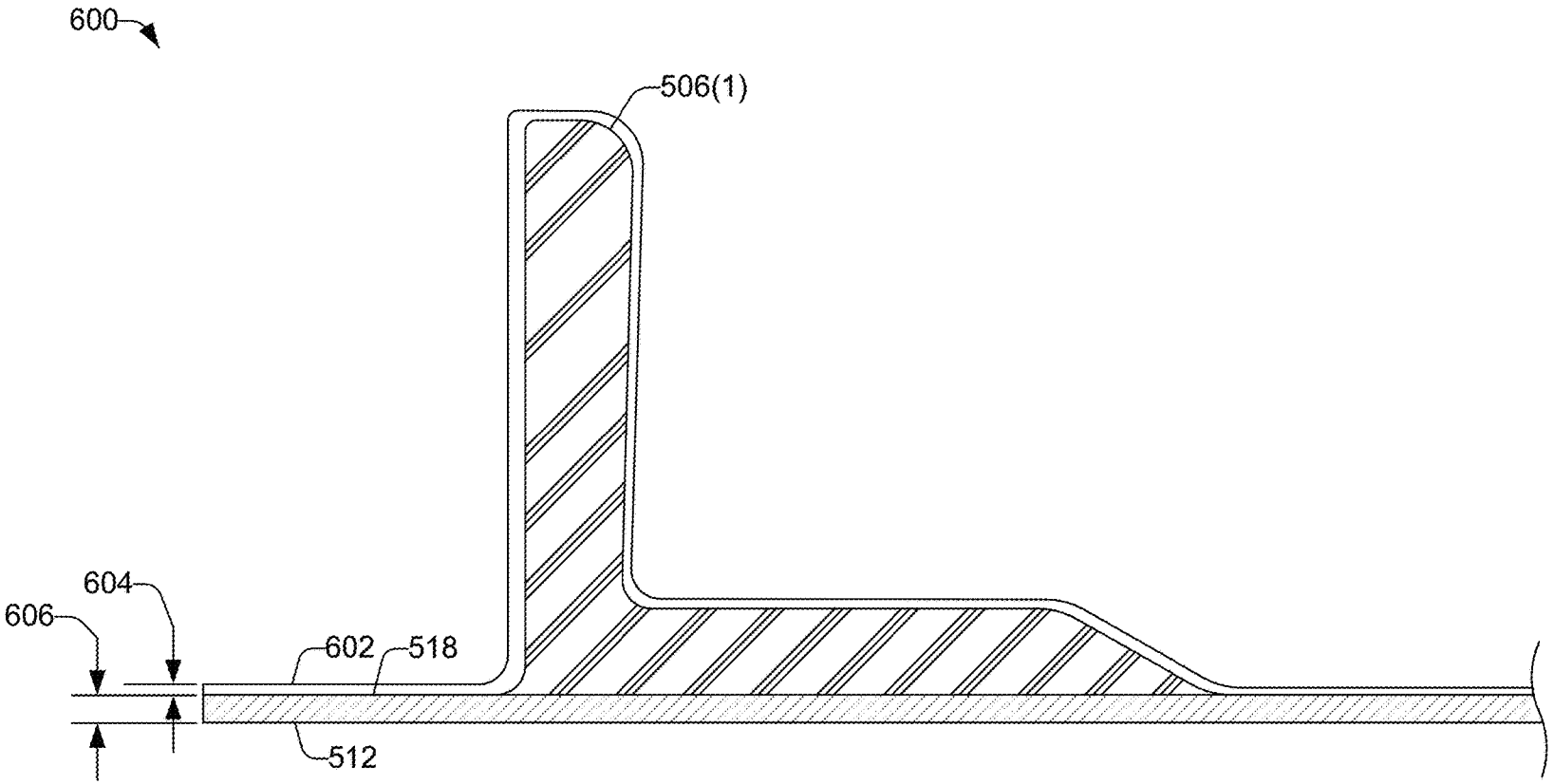
FIG. 6 illustrates a detail cross-sectional view of a portion of the tank wrap illustrated in FIG. 5.

FIG. 6 illustrates a cross-section 522 of a portion of the tank wrap 502 taken along section line A-A.

FIG. 6 illustrates a cross-section view 600 taken along the section line A-A illustrated in FIG. 5. Cross-section view 600 illustrates a layer 602 of sprayable polymer (e.g., a polyurea, such as sprayable polyurea) that substantially covers the first and second coupling members 506(1) and 506(2) and the one or more tab members 508(1) and 508(*n*) on the exterior surface 518 of the single unit of polymer 512. The layer 602 of sprayable polymer may be chemically bonded to the first and second coupling members 506(1) and 506(2), the one or more tab members 508(1) and 508(*n*), and the exterior surface 518 of the single unit of polymer 512. As discussed above, the layer 602 of sprayable polymer may have a wall thickness 604 ranging from about 0.01 inches (0.2 millimeters) to about 0.04 inches (1 millimeter). In another example, the wall thickness 604 may be about 0.02 inches (0.5 millimeters).

Cross-section view 600 illustrates the single unit of polymer 512 may have a wall thickness 606 ranging from about 0.06 inches (1.5 millimeters) to about 0.08 inches (2 millimeters).

CONCLUSION

Although the disclosure uses language specific to structural features and/or methodological acts, the claims are not limited to the specific features or acts described. Rather, the specific features and acts are disclosed as illustrative forms of implementing the invention. For example, the various embodiments described herein may be rearranged, modified, and/or combined. As another example, one or more of the method acts may be performed in different orders, combined, and/or omitted entirely, depending on the tank wrap systems to be produced.

What is claimed is:

1. A tank wrap system for covering an exterior of a container comprising:

a first tank wrap including:

a first single sheet formed of a first polymer defining a first layer, the first single sheet having an interior surface and an exterior surface;

a first coupling member formed of a second polymer defining a second layer; and a sprayable polymer defining a third layer, the third layer of the sprayable polymer covering the first layer and the second layer, wherein the sprayable polymer is chemically bonded to the exterior surface of the first single sheet and the first coupling member such that the sprayable polymer bonds the first coupling member to the exterior surface of the first single sheet;

a second tank wrap including:

a second single sheet formed of the first polymer defining a fourth layer, the second single sheet having an interior surface and an exterior surface;

a second coupling member formed of the second polymer defining a fifth layer;

the third layer of the sprayable polymer covering the fourth layer and the fifth layer, wherein the sprayable polymer is chemically bonded to the exterior surface of the second single sheet and the second coupling member such that the sprayable polymer bonds the second coupling member to the exterior surface of the second single sheet; and wherein the first coupling member of the first tank wrap and the second coupling member of the second tank wrap allow the tank wrap system to removably cover the exterior of the container.

2. The tank wrap system of claim 1, wherein the first coupling member is a first bracket member arranged a distance from an edge of the first single sheet, and the second coupling member is a second bracket member arranged on an edge of the second single sheet of the first polymer; and wherein the edge of the second single sheet of the first polymer overlaps the edge of the first single sheet of the first polymer, and the second bracket member abuts the first bracket member.

3. The tank wrap system of claim 2, wherein the edge of the first single sheet is a first edge of the first single sheet and the first tank wrap further includes a first tab member formed of the second polymer and affixed to the exterior surface of the first single sheet a distance from a second edge of the first single sheet of the first polymer, and the edge of the second single sheet is a first edge of the second single sheet and the second tank wrap further includes a second tab member formed of the second polymer and affixed to the exterior surface of the second single sheet a distance from a second edge of the second single sheet.

4. The tank wrap system of claim 3, further comprising:

a third tank wrap including a third single sheet formed of the first polymer having an edge; and wherein the edge of the third single sheet overlaps the first edge of the first single sheet, and the first tab member abuts the edge of the third single sheet, or wherein the edge of the third single sheet overlaps the first edge of the second single sheet, and the second tab member abuts the edge of the third single sheet.

5. The tank wrap system of claim 3, further comprising:

a third tank wrap including:

a third single sheet formed of the first polymer, the third single sheet having an interior, an exterior surface, and an edge;

a third tab member formed of the second polymer and affixed to the exterior surface of the third single sheet; and wherein the edge of the third single sheet overlaps the edge of the first single sheet, and the first tab member of the first tank wrap abuts the third tab member of the third tank wrap, or wherein the edge of the third single sheet overlaps the edge of the second single sheet, and the second tab member of the second tank wrap abuts the third tab member of the third tank wrap.

6. The insulated tank wrap system of claim 5, wherein the tab member is arranged on the edge of the third single sheet.

7. A tank wrap for covering an exterior of a container comprising:

a single sheet formed of a first polymer defining a first layer, the single sheet having an interior surface to face the container, and an exterior surface that faces opposite the interior surface; and a first bracket member formed of a second polymer defining a second layer, the first bracket member bonded to the exterior surface a distance from a first edge of the single sheet;

a second bracket member formed of the second polymer defining the second layer the second bracket member bonded to the exterior surface on a second edge of the single sheet; and a sprayable polymer defining a third layer, the third layer of the sprayable polymer covering the first layer and the second layer, wherein the sprayable polymer is chemically bonded to the exterior surface of the single sheet, the first bracket member, and the second bracket member such that the sprayable polymer bonds the first bracket member and the second bracket member to the exterior surface of the single sheet.

8. The tank wrap of claim 7, wherein the distance from which the first bracket member is affixed to the exterior surface of the single sheet is about three inches from the first edge of the single sheet.

9. The tank wrap of claim 7, further including a first tab member formed of the second polymer and affixed to the exterior surface of the single sheet a distance from a third edge of the single sheet.

10. The tank wrap of claim 9, wherein the distance from which the first tab member is affixed to the exterior surface of the single sheet is about three inches from the third edge of the single sheet.

11. The tank wrap of claim 7, further including:

a first tab member formed of the second polymer and affixed to the exterior surface of the single sheet a distance from a third edge of the single sheet; and a second tab member formed of the second polymer and affixed to the exterior surface of the single sheet on a fourth edge of the single sheet.

12. The tank wrap of claim 11, wherein the distance from which the first tab member is affixed to the exterior surface of the single sheet is about three inches from the third edge of the single sheet.

13. The tank wrap of claim 7, further including a first tab member and a second tab member, each of the first tab member and the second tab member formed of the second polymer and affixed to the exterior surface of the single sheet a distance from a third edge of the single sheet; and a third tab member and a fourth tab member, each of the third tab member and the fourth tab member formed of the second polymer and affixed to the exterior surface of the single sheet on a fourth edge of the single sheet.

14. The tank wrap of claim 7, wherein the single sheet is deformable to have a curvilinear shape having an arc to thereby surround the container.

15. The tank wrap of claim 7, wherein the first polymer comprises a sprayable polyurea.

16. The tank wrap of claim 7, wherein the second polymer comprises a self-leveling polyurea.

* * * * *